US007004132B2

(12) United States Patent
Matsuda et al.

(10) Patent No.: US 7,004,132 B2
(45) Date of Patent: Feb. 28, 2006

(54) VALVE TRAIN FOR OHV ENGINE

(75) Inventors: Minoru Matsuda, Saitama (JP); Makoto Sanada, Saitama (JP); Kazuhiro Uehara, Saitama (JP); Atsushi Niimi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 18 days.

(21) Appl. No.: 10/886,537

(22) Filed: Jul. 9, 2004

(65) Prior Publication Data

US 2005/0034698 A1 Feb. 17, 2005

(30) Foreign Application Priority Data

Jul. 25, 2003 (JP) ..... 2003-279670

(51) Int. Cl.
*F01L 1/18* (2006.01)

(52) U.S. Cl. ..... 123/90.39; 123/90.44; 123/90.61

(58) Field of Classification Search ..... 123/90.16, 123/90.17, 90.2, 90.39, 90.4, 90.44, 90.6, 123/90.61, 198 F, 198 P, 27, 31; 74/559, 74/569

See application file for complete search history.

(56) References Cited

U.S. PATENT DOCUMENTS 6,634,330 B1 * 10/2003 Matsuda et al. ..... 123/90.39
6,883,485 B1 * 4/2005 Fukuzawa et al. ..... 123/90.61

FOREIGN PATENT DOCUMENTS

JP 2002-213221 A 7/2002

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

To reduce the size and weight of an engine body and improve the mountability and maintainability of transmitting rods in a valve train for an OHV engine having a crankshaft, a crankcase for rotatably supporting the crankshaft, a camshaft incorporated in the crankcase, cylinder heads connected to the crankcase, engine valves operably provided in the cylinder heads, and the transmitting rods for transmitting a valve operating force due to the rotation of the camshaft to the engine valves. The transmitting rods as pull rods are arranged on one side of cylinder barrels. One end portion of each transmitting rod is formed with an engaging portion disengageably engaged with a hook portion of a mating member. An engine body or a guide member, fixed to the engine body, is provided with a guide portion for guiding the engaging portion to the hook portion of the mating member.

20 Claims, 14 Drawing Sheets

VALVE TRAIN FOR OHV ENGINE

CROSS-REFERENCE TO RELATED APPLICATIONS

The present application claims priority under 35 USC 119 to Japanese Patent Application No. 2003-279670 filed on Jul. 25, 2003 the entire contents thereof is hereby incorporated by reference.

BACKGROUND OF THE INVENTION

1. Field of the Invention

The present invention relates to a valve train for an OHV engine having a crankshaft, a crankcase for rotatably supporting the crankshaft, a camshaft incorporated in the crankcase so as to be rotated by transmission of rotational power from the crankshaft, cylinder barrels having cylinder bores, cylinder heads connected through the cylinder barrels to the crankcase, engine valves operably provided in the cylinder heads, and transmitting rods for transmitting a valve operating force due to the rotation of the camshaft to the engine valves.

2. Description of Background Art

A valve train is known as set forth in Japanese Patent Laid-Open No. 2002-213221. In the Japanese Patent Laid-Open No. 2002-213221, the engine body is formed with a chamber for accommodating the transmitting rods from the crankcase through the cylinder barrels to the cylinder heads, causing an increase in size of the engine body. Accordingly, it has been considered to arrange the transmitting rods on one side of the cylinder barrels, thereby reducing the size and weight of the engine body. The opposite ends of each transmitting rod are interlockingly coupled to mating members in the engine body. In this case, it is necessary to improve the mountability of each transmitting rod to the mating members upon maintenance such as replacement of each transmitting rod. In particular, when each transmitting rod is a pull rod, it is necessary to easily engage the rod with the mating members.

SUMMARY AND OBJECTS OF THE INVENTION

It is accordingly an object of the present invention to provide a valve train for an OHV engine which can reduce the size and weight of the engine body and improve the mountability and maintainability of the transmitting rods.

In accordance with the present invention, there is provided a valve train for an OHV engine having a crankshaft, a crankcase for rotatably supporting the crankshaft, a camshaft incorporated in the crankcase so as to be rotated by transmission of rotational power from the crankshaft, cylinder barrels having cylinder bores, cylinder heads connected through the cylinder barrels to the crankcase, engine valves operably provided in the cylinder heads, and transmitting rods for transmitting a valve operating force due to the rotation of the camshaft to the engine valves.

The transmitting rods can be formed as pull rods adapted to be pulled toward the crankcase in concert with the rotation of the camshaft and are arranged on one side of the cylinder barrels. One end portion of each transmitting rod is formed with an engaging portion disengageably engaged with a hook portion of a mating member. A guide member is fixed to an engine body including the crankcase, the cylinder barrels, and the cylinder heads. The engine body or the guide member is provided with a guide portion for guiding the engaging portion to the hook portion.

In accordance with the present invention, there is provided a valve train for an OHV engine having a crankshaft, a crankcase for rotatably supporting the crankshaft, a camshaft incorporated in the crankcase so as to be rotated, with the axis parallel to the axis of the crankshaft, by transmission of rotational power from the crankshaft, cylinder barrels having cylinder bores, cylinder heads connected through the cylinder barrels to the crankcase, engine valves operably provided in the cylinder heads, and transmitting rods for transmitting a valve operating force due to the rotation of the camshaft to the engine valves.

A support member is fixed to an engine body including the crankcase, the cylinder barrels, and the cylinder heads. The engine body or the support member is formed with first engagement holes for removably engaging one end portion of cylindrical rod cases accommodating the transmitting rods arranged on one side of the cylinder barrels and second engagement holes for removably engaging the other end portions of the rod cases. A lock member for inhibiting axial movement of the rod cases engaged with the first engagement holes is detachably mounted on the engine body or the support member.

In accordance with the present invention, the transmitting rods are inclined closer to the axes of the cylinder bores toward the cylinder heads.

In accordance with the present invention, the hook portion is formed at an end portion of a connecting arm of the mating member, the hook portion being composed of a pair of substantially C-shaped hook plates opposed to each other with a slit defined therebetween. The engaging portion is composed of a support plate and an engaging pin fixed to the support plate, the engaging pin being disengageably engaged with the hook plates, the support plate being removably inserted into the slit.

The guide member has a slide groove and an inclined surface connected to the slide groove to form the guide portion. The slide groove allows a sliding of the support plate from the closed side of the hook plates to the open side thereof and is opposed to the end portion of the connecting arm. The inclined surface guides the support plate to such a position that the engaging pin is opposed to the open side of the hook plates.

The guide member is formed by bending a single metal plate. The guide member is fixed to the engine body in the vicinity of the hook portion.

According to the present invention, the transmitting rods are arranged on one side of the cylinder barrels, so that the size and weight of the engine body can be reduced. Further, in engaging the engaging portion formed at one end portion of each transmitting rod as a pull rod to the hook portion of the mating member, the engaging portion can be guided by the guide portion, so that the mountability and maintainability of each transmitting rod can be improved.

According to the present invention, the transmitting rods are arranged on one side of the cylinder barrels, so that the size and weight of the engine body can be reduced. Further, each transmitting rod is accommodated in the corresponding rod case and one end portion of each rod case can be easily removed from the engine body or the support member, thereby improving the mountability and maintainability of each transmitting rod. Further, any means for fixing each rod case at its other end portion is not required, so that the structure can be simplified.

According to the present invention, a side projection of the transmitting rods from the cylinder heads of the engine body can be suppressed to thereby contribute to a reduction in size of the engine.

According to the present invention, the guide member can be easily formed with a reduced number of parts, thus contributing to an improvement in productivity.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will now be described with reference to the attached drawings wherein FIGS. 1 to 14 show a preferred embodiment of the present invention applied to a four-cycle, horizontally opposed, four-cylinder engine.

Figure 1:
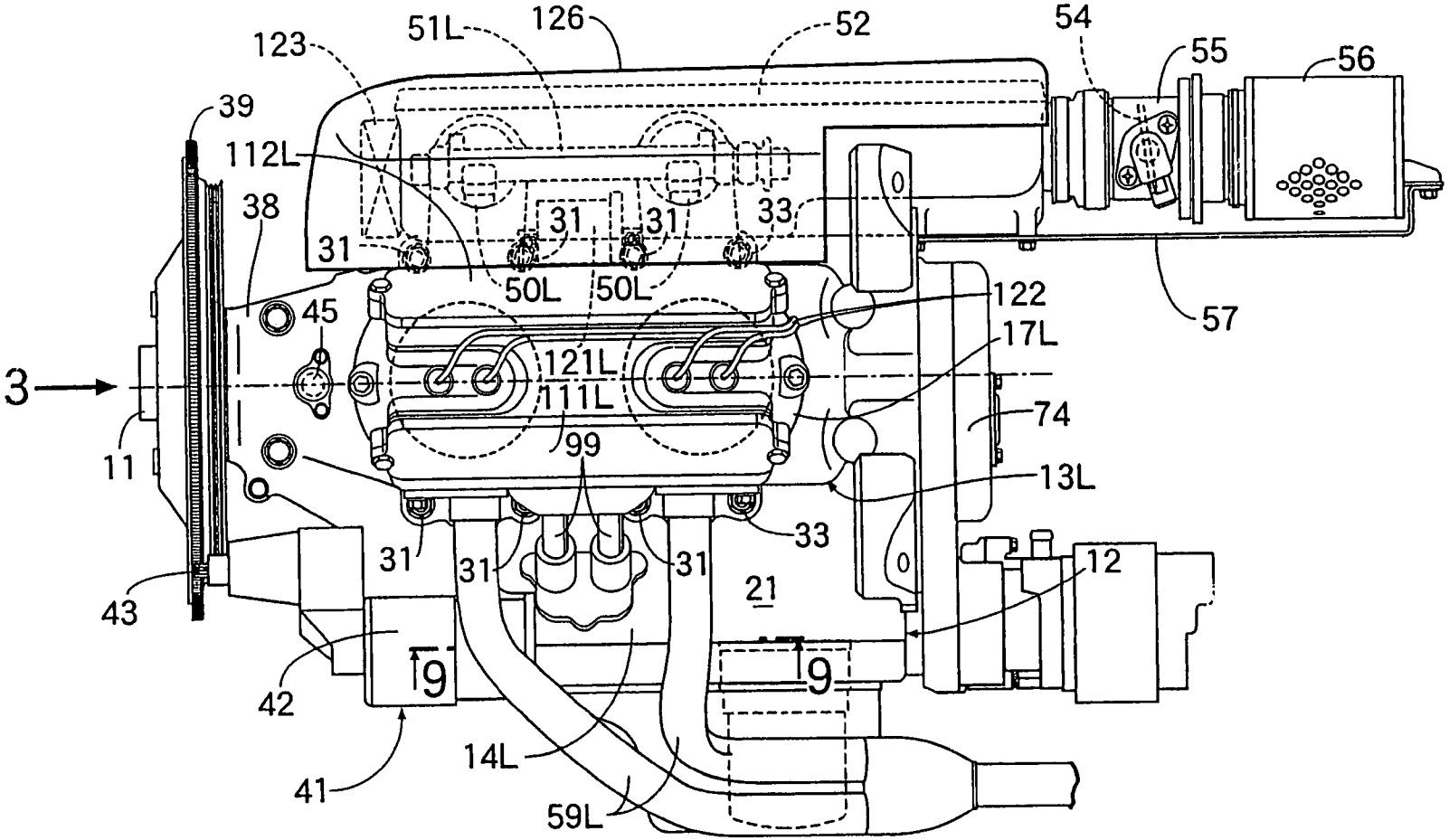
FIG. 1 is a side view of an engine.
Figure 2:
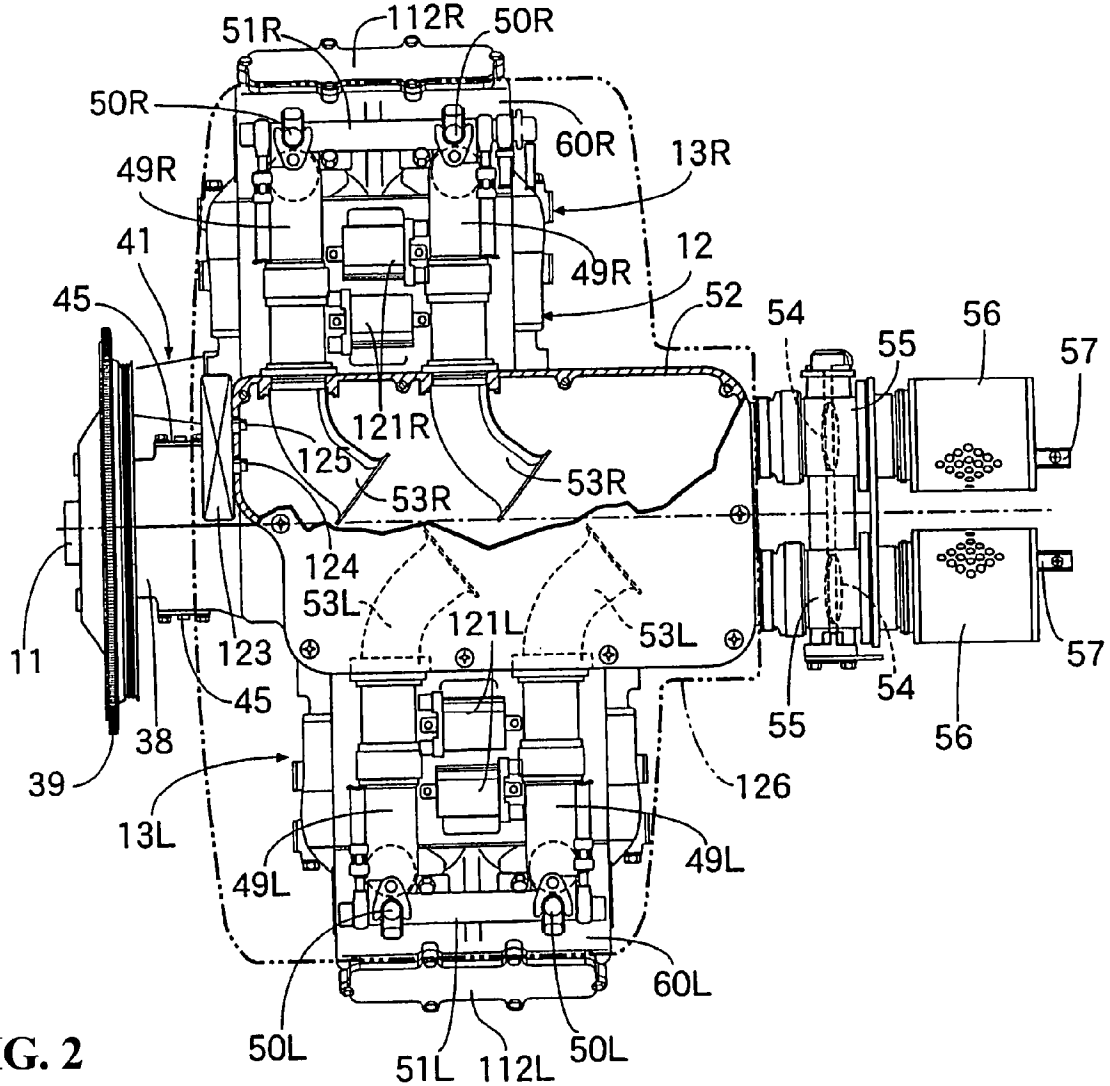
FIG. 2 is a partially cutaway, top plan view of the engine.
Figure 3:
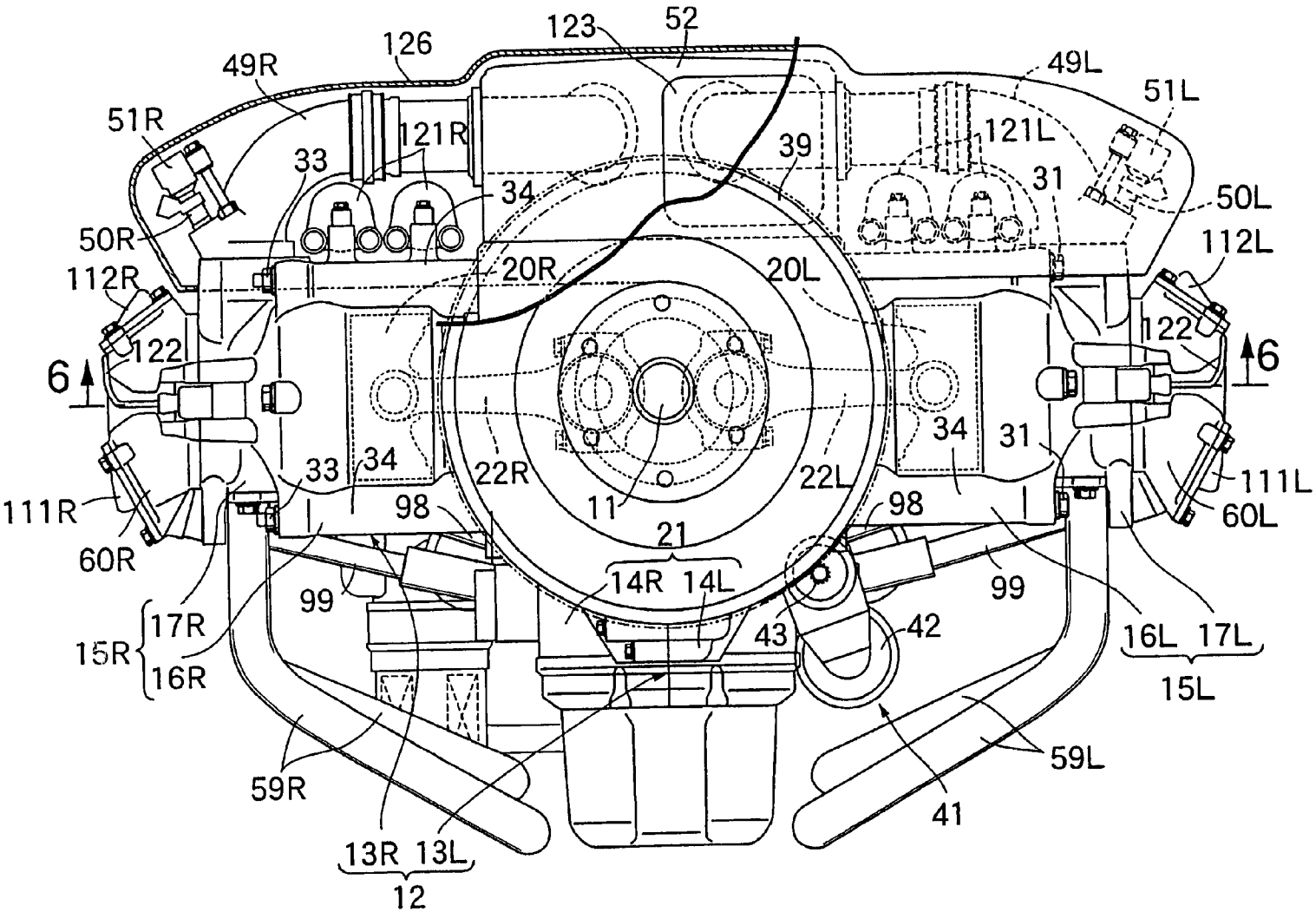
FIG. 3 is an enlarged front view taken in the direction of arrow 3 in FIG. 1.

Referring first to FIGS. 1 to 3, the four-cycle, horizontally opposed, four-cylinder engine is adapted to be mounted on an aircraft in such a manner that the engine is accommodated in a front cowl of the body of the aircraft and the axis of a crankshaft 11 extends in the longitudinal direction of the body of the aircraft. A spinner having a plurality of propeller blades is coaxially connected to the crankshaft 11.

Figure 4:
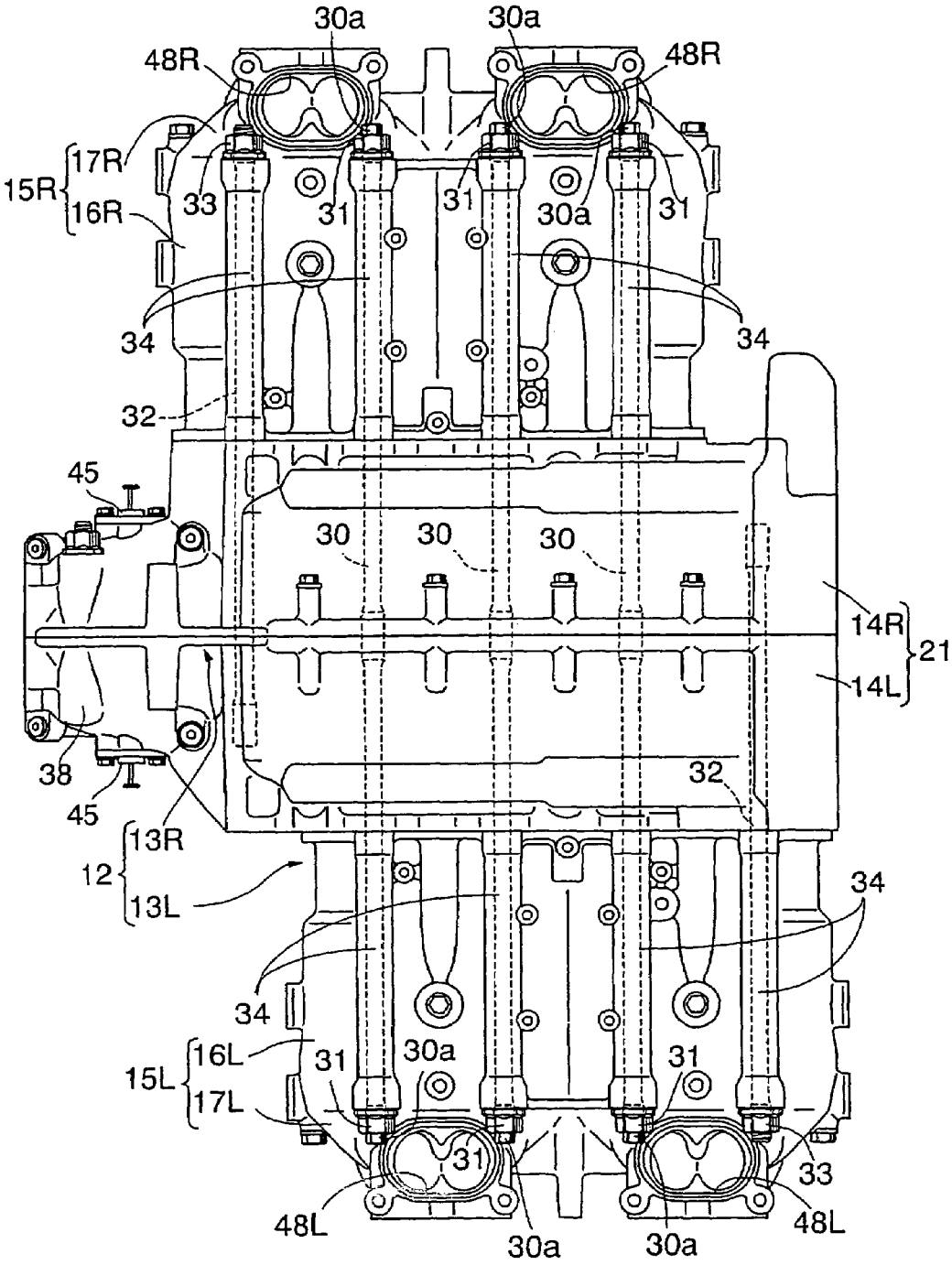
FIG. 4 is a top plan view of an engine body.
Figure 5:
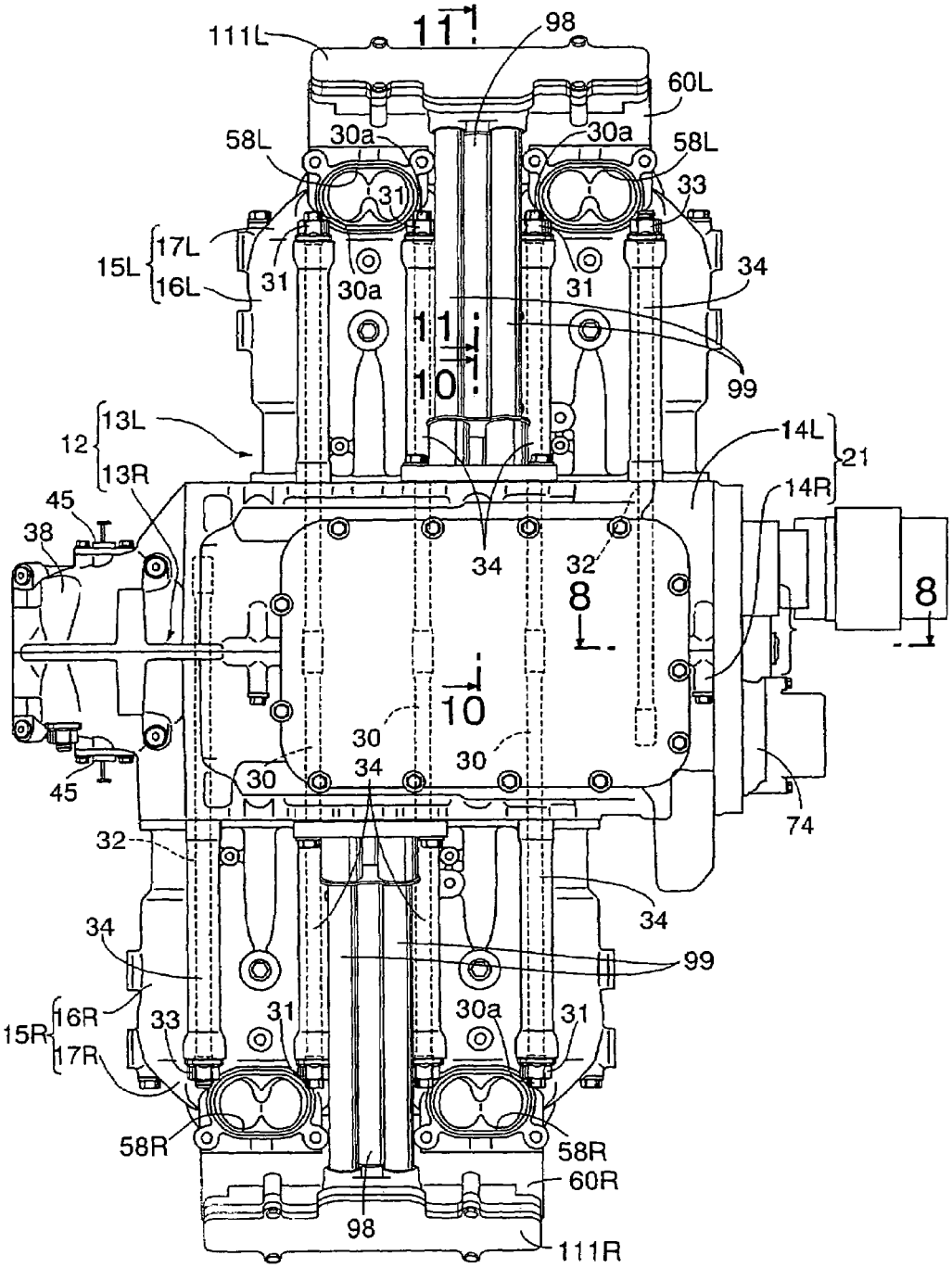
FIG. 5 is a bottom plan view of the engine body.

Referring also to FIGS. 4 and 5, the engine has an engine body 12. The engine body 12 is composed of a left engine block 13L arranged on the left side as viewed from the rear side of the engine and a right engine block 13R arranged on the right side as viewed from the rear side of the engine.

The left engine block 13L is composed of a left crankcase 14L and a left cylinder block 15L connected to the left crankcase 14L. The right engine block 13R is composed of a right crankcase 14R connected to the left crankcase 14L and a right cylinder block 15R connected to the right crankcase 14R opposite to the left crankcase 14L.

The left cylinder block 15L is composed of a left cylinder barrel 16L connected to the left crankcase 14L and a left cylinder head 17L integrated with the left cylinder barrel 16L opposite to the left crankcase 14L. The right cylinder block 15R is composed of a right cylinder barrel 16R connected to the right crankcase 14R and a right cylinder head 17R integrated with the right cylinder barrel 16R opposite to the right crankcase 14R.

Figure 6:
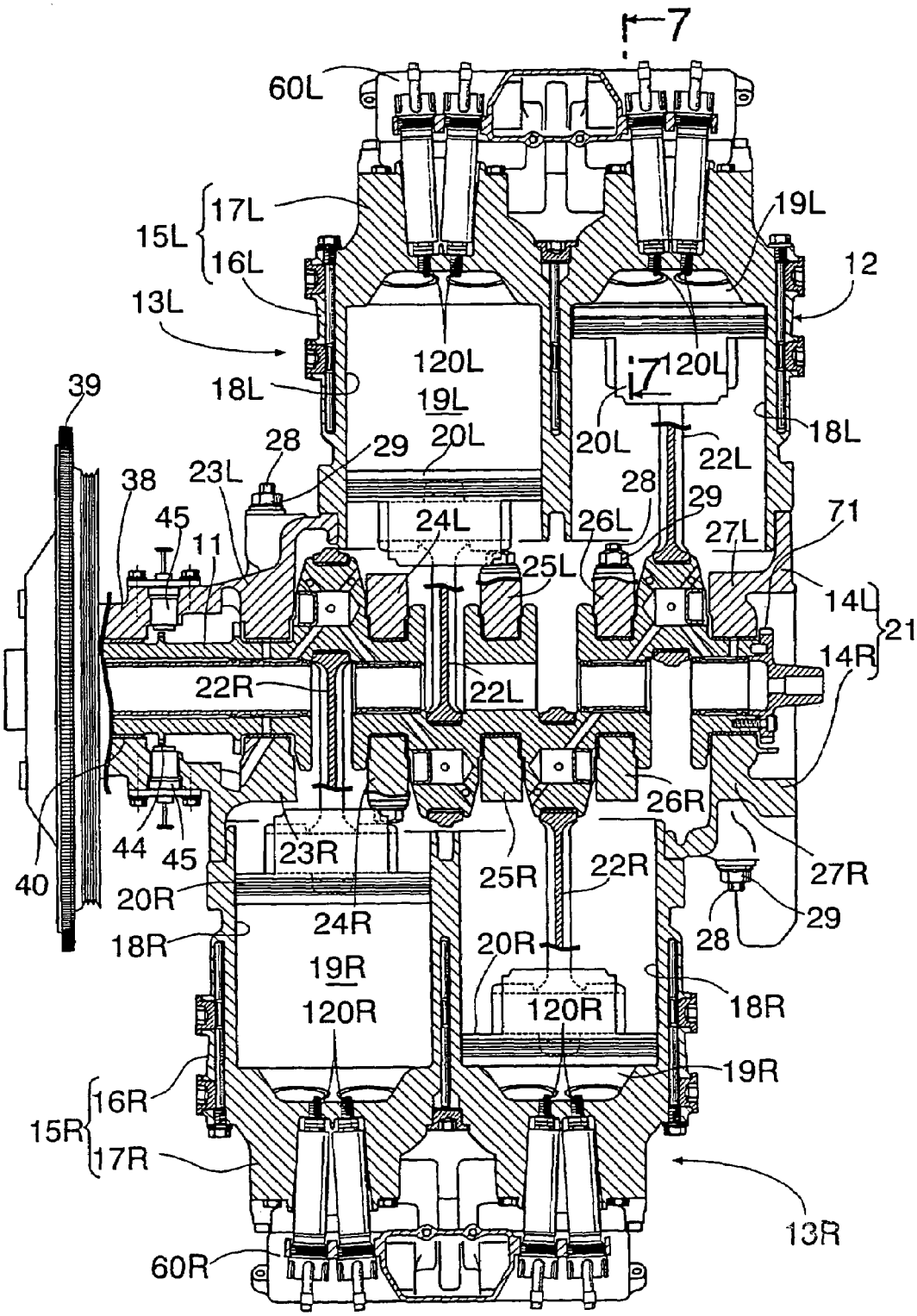
FIG. 6 is a cross section taken along the line 6—6 in FIG. 3.

Referring also to FIG. 6, the cylinder barrel 16L of the left cylinder block 15L includes two cylinder bores 18L arranged in the axial direction of the crankshaft 11. Similarly, the cylinder barrel 16R of the right cylinder block 15R includes two cylinder bores 18R arranged in the axial direction of the crankshaft 11. The cylinder bores 18L are opposed to the cylinder bores 18R with the crankshaft 11 interposed therebetween. The cylinder bores 18L are offset from the cylinder bores 18R in the axial direction of the crankshaft 11. A piston 20L is slidably fitted with each cylinder bore 18L, and a combustion chamber 19L is defined between each piston 20L and the cylinder head 17L. Similarly, a piston 20R is slidably fitted with each cylinder bore 18R, and a combustion chamber 19R is defined between each piston 20R and the cylinder head 17R.

The left and right engine blocks 13L and 13R are opposed to each other in such a manner that the axes of all the cylinder bores 18L and 18R extend substantially horizontally. The left and right crankcases 14L and 14R are connected together to configure a crankcase 21. The crankshaft 11 is connected through connecting rods 22L and 22R to the pistons 20L and 20R, and is rotatably supported between the left and right crankcases 14L and 14R.

The left crankcase 14L is formed with a front journal support wall 23L, first intermediate journal support wall 24L, second intermediate journal support wall 25L, third intermediate journal support wall 26L, and rear journal support wall 27L for supporting a left half portion of the crankshaft 11 on the front and rear sides of the connecting rods 22L. These journal support walls 23L to 27L are spaced from each other in the axial direction of the crankshaft 11. Similarly, the right crankcase 14R is formed with a front journal support wall 23R, first intermediate journal support wall 24R, second intermediate journal support wall 25R, third intermediate journal support wall 26R, and rear journal support wall 27R for supporting a right half portion of the crankshaft 11 on the front and rear sides of the connecting rods 22R. These journal support walls 23R to 27R are spaced from each other in the axial direction of the crankshaft 11. Accordingly, the crankshaft 11 is rotatably supported by the journal support walls 23L to 27L of the left crankcase 14L and the journal support walls 23R to 27R of the right crankcase 14R.

The journal support walls 23L to 27L of the left crankcase 14L are fastened to the journal support walls 23R to 27R of the right crankcase 14R, respectively, by a plurality of upper and lower pairs of stud bolts 28 and nuts 29 arranged so that the crankshaft 11 is interposed between each pair of stud bolts 28 and nuts 29.

The stud bolts 28 for fastening the front journal support walls 23L and 23R and the rear journal support walls 27L and 27R are longer than the stud bolts 28 for fastening the first intermediate journal support walls 24L and 24R, the second intermediate journal support walls 25L and 25R, and the third intermediate journal support walls 26L and 26R.

The stud bolts 28 for fastening the front journal support walls 23L and 23R are implanted into the front journal support wall 23R of the right crankcase 14R and are inserted through the front journal support wall 23L of the left crankcase 14L. The nuts 29 are threadedly engaged with the stud bolts 28 so as to abut against the outer surface of the left crankcase 14L. Similarly, the stud bolts 28 for fastening the rear journal support walls 27L and 27R are implanted into the rear journal support wall 27L of the left crankcase 14L and inserted through the rear journal support wall 27R of the right crankcase 14R. The nuts 29 are threadedly engaged with the stud bolts 28 so as to abut against the outer surface of the right crankcase 14R.

The stud bolts 28 for fastening the second intermediate journal support walls 25L and 25R and the third intermediate journal support walls 26L and 26R are implanted into the second and third intermediate journal support walls 25R and 26R of the right crankcase 14R and inserted through the second and third intermediate journal support walls 25L and 26L of the left crankcase 14L. The nuts 29 are threadedly engaged with the stud bolts 28 so as to abut against the outer surfaces of the second and third journal support walls 25L and 26L. Similarly, the stud bolts 28 for fastening the first intermediate journal support walls 24L and 24R are implanted into the first intermediate journal support wall 24L of the left crankcase 14L and inserted through the first intermediate journal support wall 24R of the right crankcase 14R. The nuts 29 are threadedly engaged with the stud bolts 28 so as to abut against the outer surface of the first journal support wall 24R.

The left and right engine blocks 13L and 13R are connected together by three pairs of upper and lower through bolts 30 located at positions corresponding to the first intermediate journal support walls 24L and 24R, the second intermediate journal support walls 25L and 25R, and the third intermediate journal support walls 26L and 26R, and by two pairs of upper and lower stud bolts 32 located at positions corresponding to the front journal support walls 23L and 23R and the rear journal support walls 27L and 27R.

The through bolts 30 extend through the left and right engine blocks 13L and 13R in such a manner that the stud bolts 28 for fastening the first intermediate journal support walls 24L and 24R, the second intermediate journal support walls 25L and 25R, and the third intermediate journal support walls 26L and 26R are interposed between the through bolts 30 and the crankshaft 11. Nuts 31 are threadedly engaged with the opposite end portions of the through bolts 30 projecting from the cylinder heads 17L and 17R of the left and right engine blocks 13L and 13R. Further, the opposite ends of each through bolt 30 are provided with hexagonal tool engaging portions 30*a* for engaging a tool (not shown), so as to prevent rotation of each through bolt 30 in tightening the corresponding nut 31.

One of the two pairs of stud bolts 32 are implanted into the front journal support wall 23L of the left crankcase 14L and inserted through the right engine block 13R. Nuts 33 are threadedly engaged with the stud bolts 32 projecting from the cylinder head 17R of the right engine block 13R. Similarly, the other pair of stud bolts 32 are implanted into the rear journal support wall 27R of the right crankcase 14R and inserted through the left engine block 13L. Nuts 33 are threadedly engaged with the stud bolts 32 projecting from the cylinder head 17L of the left engine block 13L.

The two pairs of stud bolts 32 are located in such a manner that the stud bolts 28 for fastening the front journal support walls 23L and 23R (of the left and right crankcases 14L and 14R) and the rear journal support walls 27L and 27R (of the left and right crankcases 14L and 14R) are interposed between the stud bolts 32 and the crankshaft 11.

Further, the through bolts 30 and the stud bolts 32 are arranged so as to surround the cylinder bores 18L and 18R at 90° intervals, for example. The cylinder blocks 15L and 15R are integrally formed with a plurality of mounting bosses 34 extending from mount surfaces of the cylinder barrels 16L and 16R to the crankcase 21 to the cylinder heads 17L and 17R. The through bolts 30 and the stud bolts 32 are inserted through the mounting bosses 34. Accordingly, the mounting bosses 34 are also arranged so as to surround the cylinder bores 18L and 18R.

A support cylinder 38 is formed at the front end of the crankcase 21 so as to project frontward. The support cylinder 38 is configured by the left and right crankcases 14L and 14R in cooperation. The front end of the crankshaft 11 extends coaxially through the support cylinder 38 and projects from the front end of the support cylinder 38. A ring gear 39 is fixed to the front end of the crankshaft 11 projecting from the front end of the support cylinder 38, and a spinner (not shown) is coaxially mounted on the ring gear 39. A sliding bearing 40 is interposed between the support cylinder 38 and the crankshaft 11 at their front portions. Further, an annular sealing member (not shown) is interposed between the support cylinder 38 and the crankshaft 11 at a position on the front side of the sliding bearing 40.

A starting device 41 is provided to give a rotational drive force to the crankshaft 11 at the starting of the engine. The starting device 41 has a known structure as including a starter motor 42 supported to a lower portion of the left crankcase 14L of the crankcase 21 and a pinion 43 adapted to project into mesh with the ring gear 39 when the rotational speed of the starter motor 42 becomes greater than or equal to a predetermined value. After starting the engine, the pinion 43 is separated from the ring gear 39 and returned to an original position.

A plurality of projections 44 are formed on the crankshaft 11 in the support cylinder 38 so as to be equally spaced in the circumferential direction of the crankshaft 11. A pair of crank angle sensors 45 for detecting a crank angle by using the projections 44 are mounted in the support cylinder 38 so as to provide a 180° phase difference.

The left cylinder head 17L is formed at its upper portion with two intake ports 48L, respectively, corresponding to the two combustion chambers 19L. Similarly, the right cylinder head 17R is formed at its upper portion with two intake ports 48R, respectively, corresponding to the two combustion chambers 19R. Each intake port 48L is bifurcated to communicate with the corresponding combustion chamber 19L, and each intake port 48R is also bifurcated to communicate with the corresponding combustion chamber 19R.

Arcuately curved intake pipes 49L and 49R are connected to the intake ports 48L and 48R, respectively. Electromagnetic fuel injection valves 50L and 50R for injecting fuel toward the intake ports 48L and 48R are mounted at intermediate portions of the intake pipes 49L and 49R, respectively. The fuel injection valves 50L on the left engine block 13L side are connected to a common fuel rail 51L, and the fuel injection valves 50R on the right engine block 13R side are connected to a common fuel rail 51R.

An intake chamber 52 is located above the crankcase 21 of the engine body 12 so as to be supported to the engine body 12. The upstream ends of the intake pipes 49L and 49R are connected to the downstream ends of connection pipes 53L and 53R, respectively. The upstream end portions of the connection pipes 53L and 53R are inserted in the intake chamber 52 from the opposite sides thereof, and are curved to be divergent and open to the rear side.

A pair of right and left throttle bodies 55 each including a throttle valve 54 rotatably supported to a lateral shaft are connected at their downstream ends to the rear end of the intake chamber 52. Air cleaners 56 are connected to the upstream ends of the throttle bodies 55, respectively. The air cleaners 56 are supported by support stays 57 mounted to the intake chamber 52 and extending rearwardly.

The left cylinder head 17L is formed at its lower portion with two exhaust ports 58L, respectively, corresponding to the two combustion chambers 19L. Similarly, the right cylinder head 17R is formed at its lower portion with two exhaust ports 58R, respectively, corresponding to the two combustion chambers 19R. Each exhaust port 58L is bifurcated, and each exhaust port 58R is also bifurcated. Exhaust pipes 59L and 59R are connected to the exhaust ports 58L and 58R, respectively. The exhaust pipes 59L and 59R extend downwardly to the lower side of the engine body 12 and further extend rearwardly.

Figure 7:
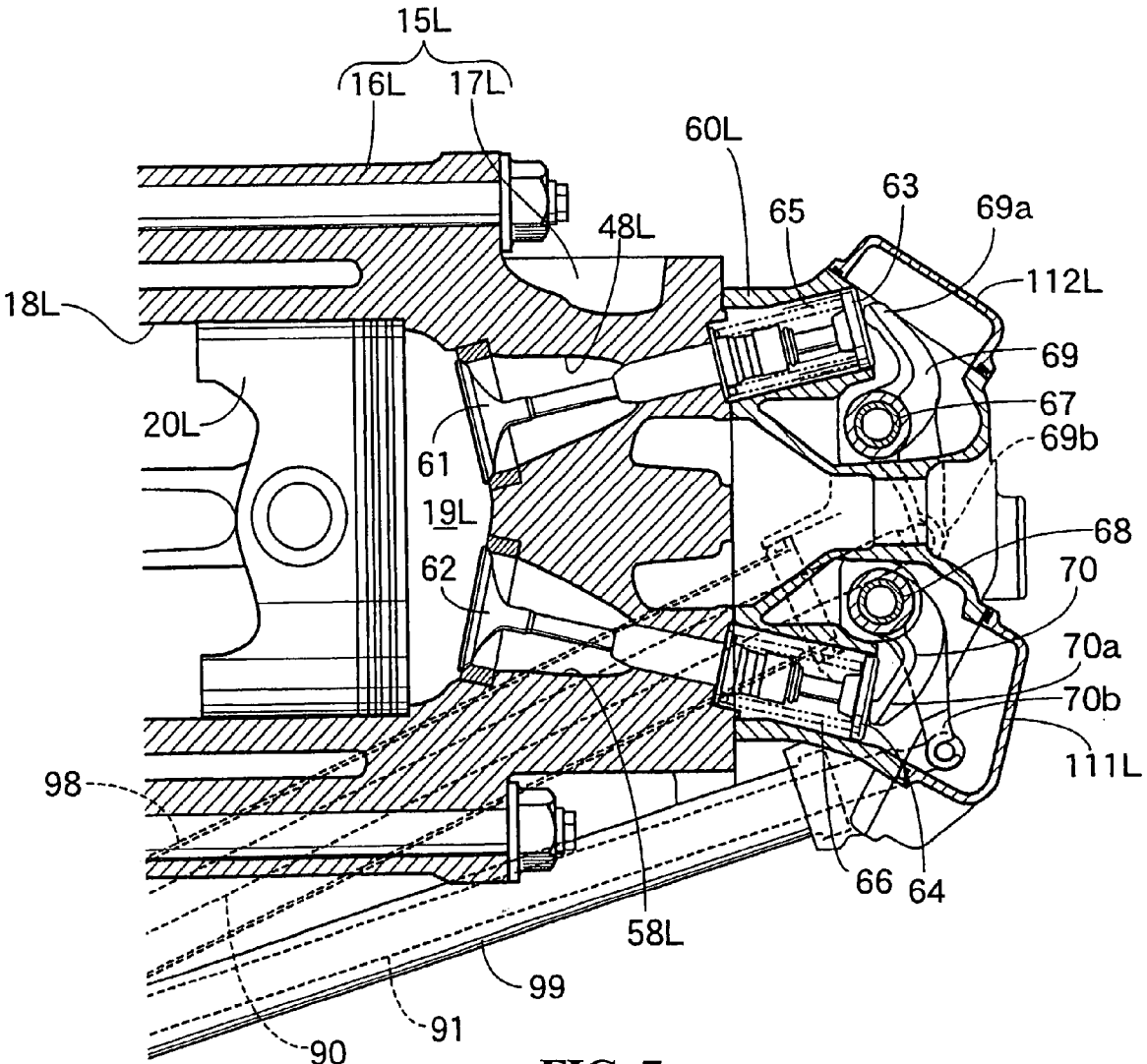
FIG. 7 is an enlarged cross section taken along the line 7—7 in FIG. 6.

Referring to FIG. 7, the left cylinder head 17L is provided with two intake valves 61 as engine valves per cylinder for respectively opening and closing the intake ports 48L. Similarly, the left cylinder head 17L is provided with two exhaust valves 62 as engine valves per cylinder for respectively opening and closing the exhaust ports 58L. Substantially H-shaped head covers 60L and 60R constituting a part of the engine body 12 are connected to the left and right cylinder heads 17L and 17R, respectively. The intake valves 61 and the exhaust valves 62 project from the cylinder heads 17L and 17R, and the projecting portions of the intake and exhaust valves 61 and 62 are provided with lifters 63 and 64, respectively. The lifters 63 and 64 are slidably fitted in the head covers 60L and 60R. A valve spring 65 for normally biasing each intake valve 61 in its closing direction is interposed under compression between each lifter 63 and the cylinder head 17L. Similarly, a valve spring 66 for normally biasing each exhaust valve 62 in its closing direction is interposed under compression between each lifter 64 and the cylinder head 17L. The same configuration applies also to the right cylinder head 17R side.

An intake rocker arm 69 is pivotably supported to an intake rocker shaft 67 extending parallel to the crankshaft 11 per cylinder. Similarly, an exhaust rocker arm 70 is pivotably supported to an exhaust rocker shaft 68 extending parallel to the crankshaft 11 per cylinder. These rocker shafts 67 and 68 and these rocker arms 69 and 70 are accommodated in each of the head covers 60L and 60R. Each intake rocker arm 69 is integrally formed with two output arms 69*a* abutting against the lifters 63 for the two intake valves 61 per cylinder and with one input arm 69*b*. The output arms 69*a* and the input arm 69*b* extend in opposite directions with respect to the intake rocker shaft 67. On the other hand, each exhaust rocker arm 70 is integrally formed with two output arms 70*a* abutting against the lifters 64 for the two exhaust valves 62 per cylinder and with one input arm 70*b*. The output arms 70*a* and the input arm 70*b* extend in the same direction with respect to the exhaust rocker shaft 68.

Figure 8:
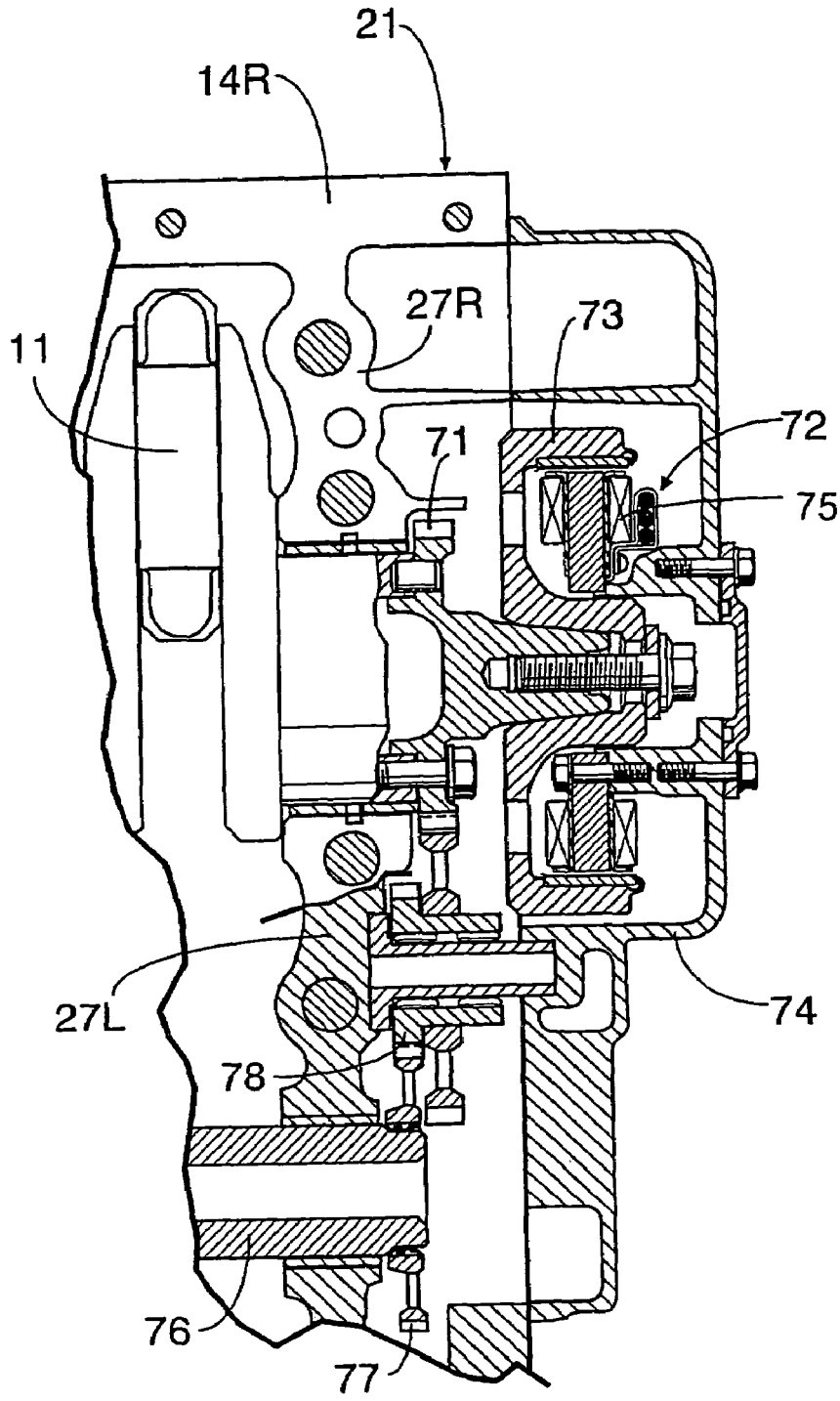
FIG. 8 is an enlarged cross section taken along the line 8—8 in FIG. 5.

Referring to FIG. 8, a drive gear 71 is coaxially mounted on the crankshaft 11 at its rear end portion projecting from the rear journal support walls 27L and 27R of the crankcase 21. A generator 72 having a rotor 73 is provided on the rear portion of the crankcase 21. The rotor 73 is coaxially connected to the drive gear 71 so that the rotation of the rotor 73 relative to the drive gear 71 is inhibited. A cover 74 is mounted on the rear portion of the crankcase 21, and a stator 75 of the generator 72 is mounted on the cover 74.

A camshaft 76 is incorporated in the crankcase 21 so as to be rotated by transmission of rotational power from the crankshaft 11. That is, the camshaft 76 having an axis parallel to the axis of the crankshaft 11 is rotatably supported to the crankcase 21. A driven gear 77 fixed to the camshaft 76 is in mesh with an idle gear 78 meshing with the drive gear 71, so that the camshaft 76 is rotationally driven by the crankshaft 11 with the rotational speed being reduced to ½.

Figure 9:
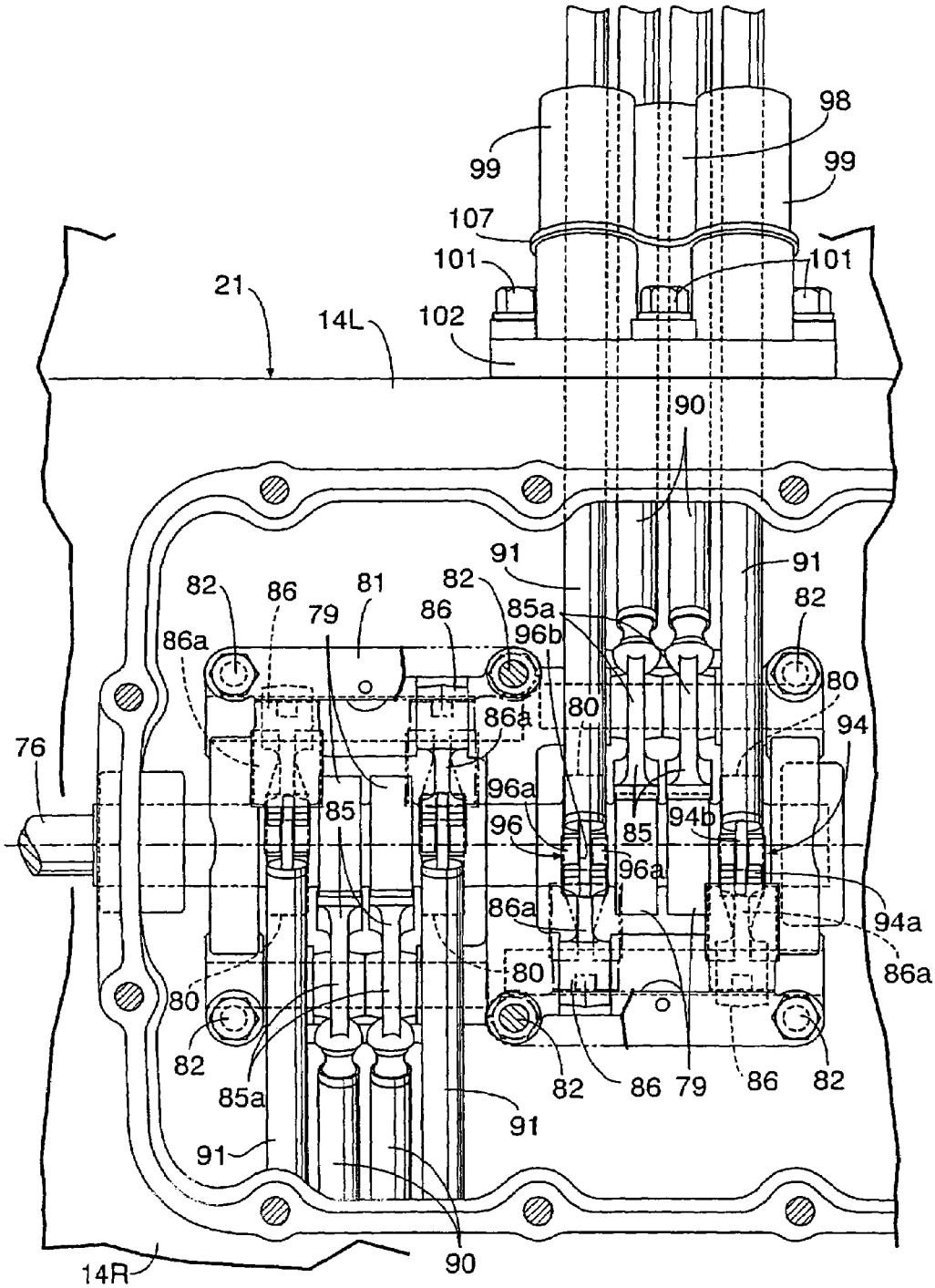
FIG. 9 is a cross section taken along the line 9—9 in FIG. 1.
Figure 10:
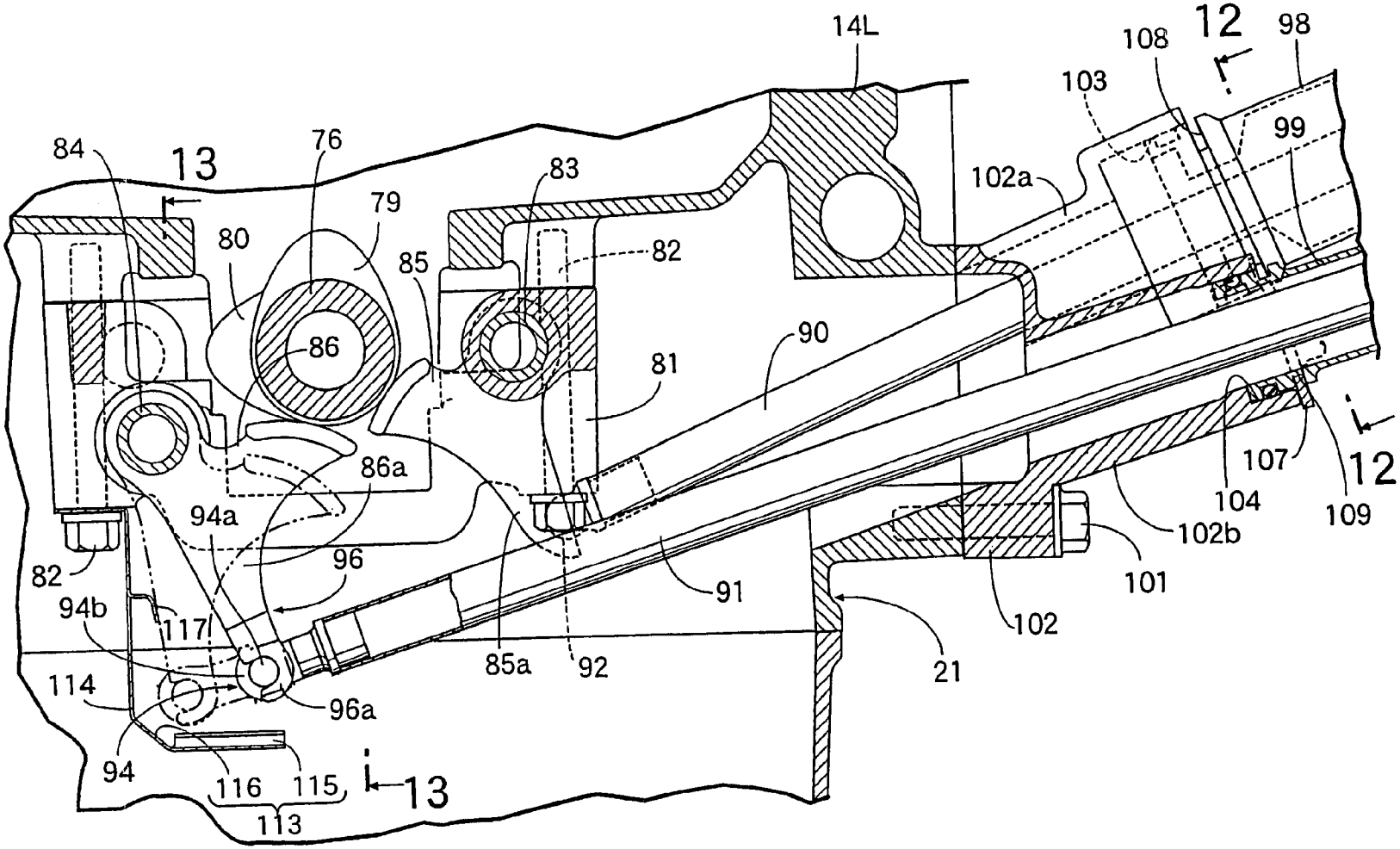
FIG. 10 is an enlarged cross section taken along the line 10—10 in FIG. 5

Referring also to FIGS. 9 and 10, the camshaft 76 is integrally formed with a pair of intake cams 79 disposed adjacent to each other and a pair of exhaust cams 80 interposing the intake cams 79 at a position between the two cylinder bores 18L in the left cylinder barrel 16L. Similarly, the camshaft 76 is integrally formed with another pair of intake cams 79 disposed adjacent to each other and another pair of exhaust cams 80 interposing the intake cams 79 at a position between the two cylinder bores 18R in the right cylinder barrel 16R.

A holder 81 is connected to the crankcase 21 by a plurality of bolts 82 so as to be laid under the camshaft 76. A pair of intake pivot shafts 83 and a pair of exhaust pivot shafts 84 parallel to the camshaft 76 are supported to the holder 81 so as to interpose the intake cams 79 and the exhaust cams 80.

A pair of intake cam followers 85 each having a connecting arm 85*a* are pivotably supported to each intake pivot shaft 83 so as to be driven by the respective intake cams 79. Similarly, a pair of exhaust cam followers 86 each having a connecting arm 86*a* are pivotably supported to each exhaust pivot shaft 84 so as to be driven by the respective exhaust cams 80.

A valve operating force by the rotation of the camshaft 76 is transmitted through first transmitting rods 90 to the intake valves 61 and through second transmitting rods 91 to the exhaust valves 62.

Each first transmitting rod 90 is a push rod adapted to be pushed away from in concert with the rotation of the camshaft 76. This rod 90 is connected between the corresponding intake cam follower 85 and the corresponding intake rocker arm 69.

Figure 11:
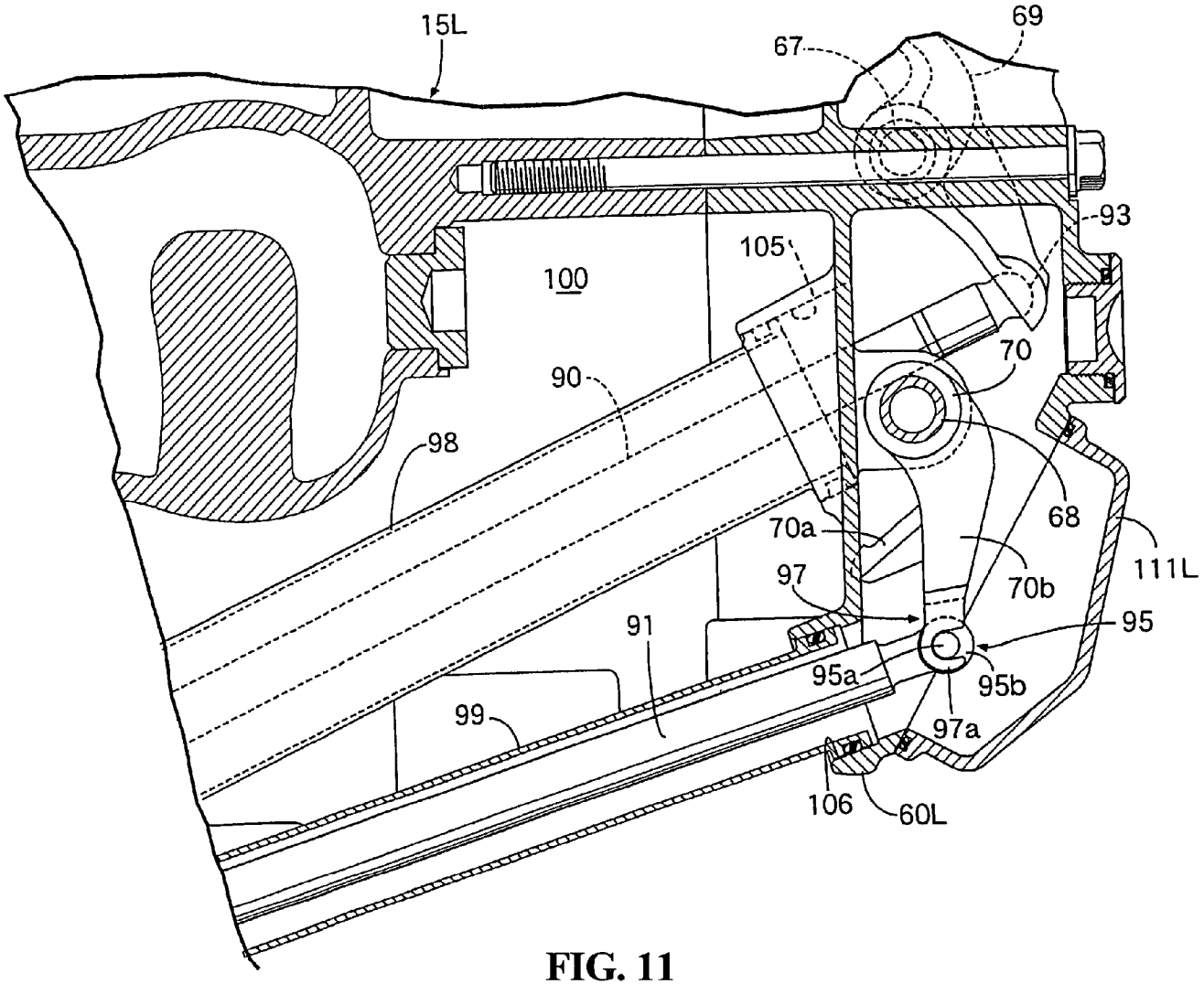
FIG. 11 is an enlarged cross section taken along the line 11—11 in FIG. 5.

Referring also to FIG. 11, each first transmitting rod 90 is formed at its opposite ends with spherical portions 92 and 93. The spherical portion 92 formed at one end of each first transmitting rod 90 is swingably received by an end portion of the connecting arm 85*a* of the corresponding intake cam follower 85. The spherical portion 93 formed at the other end of each first transmitting rod 90 is swingably received by an end portion of the connecting arm 69*b* of the corresponding intake rocker arm 69.

Each second transmitting rod 91 is a pull rod adapted to be pulled toward the crankcase 21 in concert with the rotation of the camshaft 76. This rod 91 is connected between the corresponding exhaust cam follower 86 and the corresponding exhaust rocker arm 70.

Each second transmitting rod 91 is formed at its opposite ends with engaging portions 94 and 95. The connecting arm 86*a* of each exhaust cam follower 86 is formed with a hook portion 96 disengageably engaged with the engaging portion 94. Similarly, the connecting arm 70*b* of each exhaust rocker arm 70 is formed with a hook portion 97 disengageably engaged with the engaging portion 95.

The hook portion 96 to which the engaging portion 94 formed at one end of the second transmitting rod 91 is disengageably engaged is composed of a pair of substantially C-shaped hook plates 96*a* opposed to each other with a slit 96*b* defined therebetween. Similarly, the hook portion 97 to which the engaging portion 94 formed at the other end of the second transmitting rod 91 is disengageably engaged is composed of a pair of substantially C-shaped hook plates 97*a* opposed to each other with a slit (not shown) defined therebetween.

The engaging portion 94 formed at one end of each second transmitting rod 91 is composed of an engaging pin 94*a* disengageably engaged with the hook plates 96*a* and a circular support plate 94*b* removably inserted in the slit 96*b* between the hook plates 96*a*. The engaging pin 94*a* is fixed to the circular support plate 94*b*. Similarly, the engaging portion 95 formed at the other end of each second transmitting rod 91 is composed of an engaging pin 95*a* disengageably engaged with the hook plates 97*a* and a circular support plate 95*b* removably inserted in the slit between the hook plates 97*a*. The engaging pin 95*a* is fixed to the circular support plate 95*b*.

The first and second transmitting rods 90 and 91 provided for the intake valves 61 and the exhaust valves 62 in the two cylinders on the left cylinder head 17L side are located at a position between the cylinder bores 18L of the left cylinder block 15L and below the cylinder barrel 16L. Similarly, the first and second transmitting rods 90 and 91 provided for the intake valves 61 and the exhaust valves 62 in the two cylinders on the right cylinder head 17R side are located at a position between the cylinder bores 18R of the right cylinder block 15R and below the cylinder barrel 16R.

Figure 12:
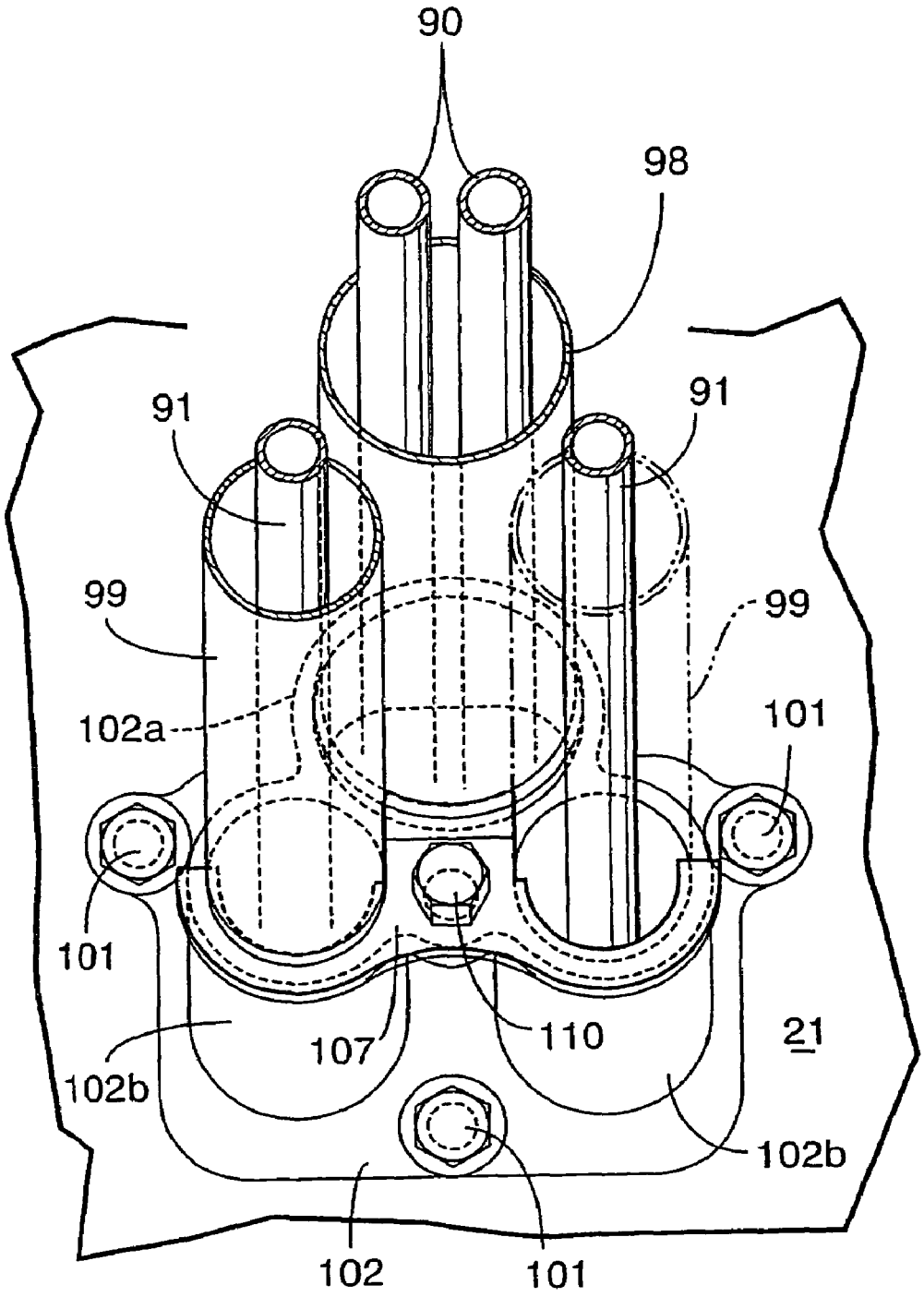
FIG. 12 is a cross section taken along the line 12—12 in FIG. 10.

As illustrated in FIG. 12, each pair of first transmitting rods 90 are commonly accommodated in a cylindrical first rod case 98, and each pair of second transmitting rods 91 are individually accommodated in a pair of cylindrical second rod cases 99 arranged on the opposite sides of the first rod case 98.

The first and second transmitting rods 90 and 91, i.e., the first and second rod cases 98 and 99 accommodating the rods 90 and 91 are inclined closer to the axes of the cylinder bores 18L and 18R toward the cylinder heads 17L and 17R. Recesses 100 for partially accommodating the rod cases 98 and 99 are formed at a portion of the left cylinder block 15L corresponding to the intermediate portion between the cylinder bores 18L and at a portion of the right cylinder block 15R corresponding to the intermediate portion between the cylinder bores 18R.

A support member 102 is fixed to the crankcase 21 in the engine body 12 by a plurality of bolts 101. The support member 102 is integrally formed with a cylindrical supporting portion 102*a* corresponding to the first rod case 98 and a pair of cylindrical supporting portions 102*b* corresponding to the pair of second rod cases 99. The cylindrical supporting portions 102*a* and 102*b* are joined together. One end portion of the first rod case 98 is inserted in the cylindrical supporting portion 102*a*, and one end portions of the second rod cases 99 are inserted in the cylindrical supporting portions 102*b*.

The inner surfaces of the upper end portions of the cylindrical supporting portions 102*a* and 102*b* are enlarged in diameter so as to form first engagement holes 103 and 104. One end portion of the first rod case 98 is hermetically engaged with the first engagement hole 103 of the cylindrical supporting portion 102*a*. In addition, one end portion of the second rod cases 99 are hermetically engaged with the first engagement holes 104 of the cylindrical supporting portions 102*b*.

Annular grooves 108 and 109 are formed on the outer circumferences of the first and second rod cases 98 and 99 at their one end portion engaged with the first engagement holes 103 and 104. A platelike lock member 107 is detachably mounted on the support member 102 by a bolt 110. The lock member 107 is engaged with the annular grooves 108 and 109 to inhibit axial movement of the rod cases 98 and 99.

Each of the head covers 60L and 60R of the engine body 12 is formed with a second engagement hole 105 for hermetically and removably engaging the other end portion of the first rod case 98 and a pair of second engagement holes 106 for hermetically and removably engaging the other end portions of the second rod cases 99. In engaging the engaging portion 95 formed at the other end portion of each second transmitting rod 91 to the hook portion 97 formed at the end portion of the connecting arm 70*b* of the corresponding exhaust rocker arm 70, the engaging portion 95 can be guided to the hook portion 97 by sliding the outer surface of the second transmitting rod 91 on the inner surface of the corresponding second engagement hole 106 in the condition where the second rod case 99 is disengaged from the corresponding second engagement hole 106.

Covers 111L and 111R are fastened to the lower portions of the head covers 60L and 60R, so as to facilitate the engagement and disengagement of each engaging portion 95 with respect to the corresponding hook portion 97 and the abutment and engagement of each first transmitting rod 90 to the connecting arm 69*b* of the corresponding intake rocker arm 69 and also to allow the mounting and demounting of each exhaust rocker arm 70. Similarly, covers 112L and 112R are fastened to the upper portions of the head covers 60L and 60R, so as to allow the mounting and demounting of each intake rocker arm 69.

Figure 13:
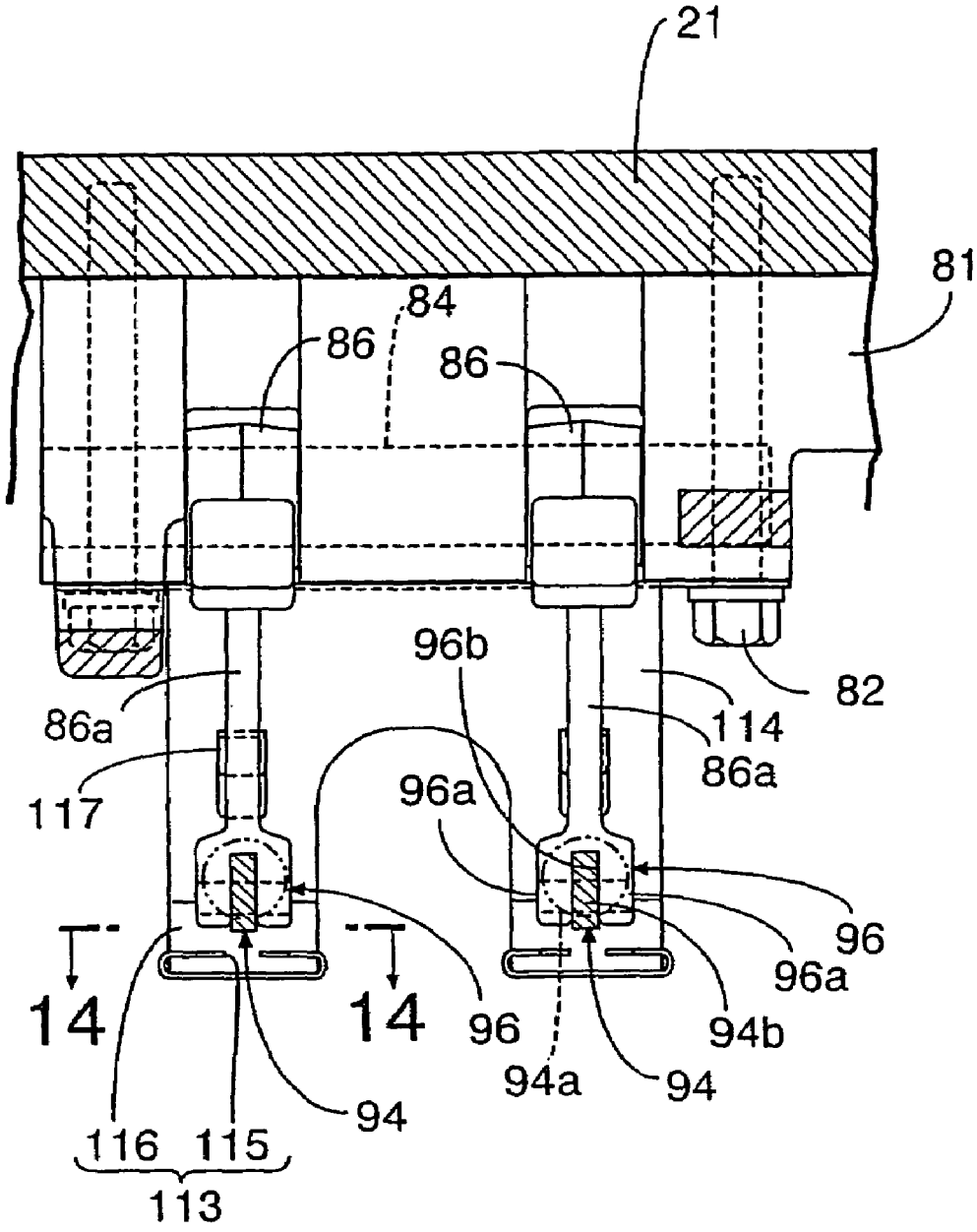
FIG. 13 is a cross section taken along the line 13—13 in FIG. 10.

Referring also to FIG. 13, a guide member 114 formed by bending a single metal plate is mounted on the crankcase 21 of the engine body 12 in the vicinity of the exhaust cam followers 86. The guide member 114 is fixed together with the holder 81 to the crankcase 21 by a part of the plurality of bolts 92 fastening the holder 81 to the crankcase 21.

Figure 14:
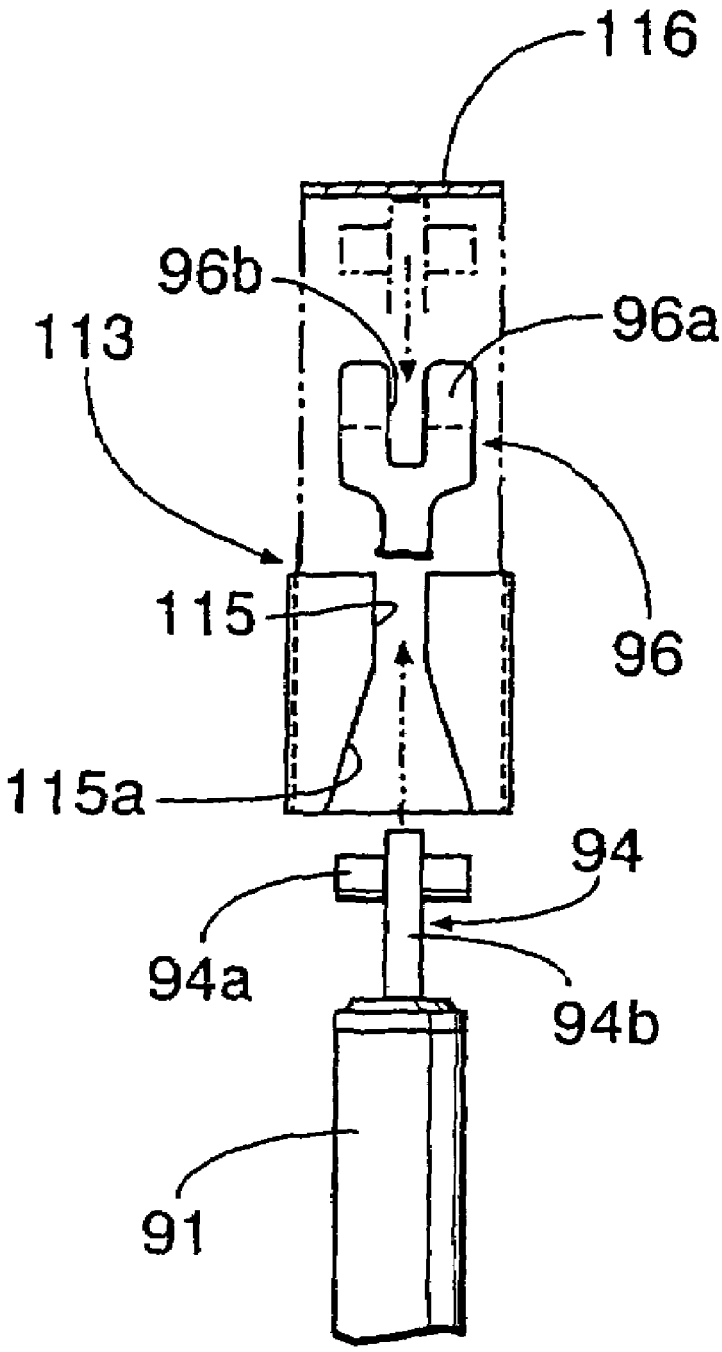
FIG. 14 is a cross section taken along the line 14—14 in FIG. 13.

Referring also to FIG. 14, the guide member 114 includes a pair of guide portions 113 for guiding the engaging portions 94 of the second transmitting rods 91 in engaging the engaging portions 94 to the hook portions 96 of the connecting arms 86*a* of the exhaust cam followers 86. Each guide portion 113 is composed of a slide groove 115 and an inclined surface 116 connected to the slide groove 115. The slide groove 115 allows for the sliding of the support plate 94*b* of the engaging portion 94, and is opposed to the end portion of the connecting arm 86*a*. The inclined surface 116 guides the support plate 94*b* to such a position that the engaging pin 94*a* of the engaging portion 94 is opposed to the open side of the hook plates 96*a* of the hook portion 96.

The slide groove 115 is formed at its end portion with a divergent portion 115*a* increased in width toward the outer end where the support plate 94*b* of the engaging portion 94 is received. This divergent portion 115*a* serves to facilitate insertion of the support plate 94*b* into the slide groove 115. Further, the guide member 114 is integrally formed with abutting portions 117 on which the exhaust cam followers 86 abut to be retained as shown by the phantom line in FIG. 10 in engaging the engaging portions 94 to the hook portions 96.

A pair of spark plugs 120L are mounted for each combustion chamber 19L in the left cylinder head 17L, and a pair of spark plugs 120R are mounted for each combustion chamber 19R in the right cylinder head 17R. A pair of ignition coils 121L such as electrical equipment are mounted on the upper surface of the left cylinder head 17L at a position between the intake pipes 49L. A pair of ignition coils 121R as electrical equipment are mounted on the upper surface of the right cylinder head 17R at a position between the intake pipes 49R. The pairs of ignition coils 121L and 121R are located on the opposite sides of the intake chamber 52. A pair of high tension cords 122 are connected between each ignition coil 121L and each pair of spark plugs 120L. A pair of high tension cords 122 are connected between each ignition coil 121R and each pair of spark plugs 120R.

To ensure the ignition in each of the combustion chambers 19L and 19R even when any one of the pair of ignition coils 121L or 121R malfunctions, the pair of high tension cords 122 connected to the same ignition coil 121L or 121R are connected to the spark plugs 120L for the different combustion chambers 19L or to the spark plugs 120R for the different combustion chambers 19R.

An electronic control unit 123 for controlling the operation of the engine is mounted on the outer surface of the front wall of the intake chamber 52. An intake air pressure sensor 124 for detecting an intake air pressure in the intake chamber 52 and an intake air temperature sensor 125 for detecting an intake air temperature in the intake chamber 52 project from the electronic control unit 123 through the front wall of the intake chamber 52 into the intake chamber 52.

The electromagnetic fuel injection valves 50L and 50R, the ignition coils 121L and 121R, and the electronic control unit 123 are arranged around the intake chamber 52, and are covered with a shield cover 126 mounted on the engine body 12 so as to cover at least a part of the intake chamber 52.

The shield cover 126 is formed from a steel plate, for example, and covers most of the intake chamber 52 except a rear portion thereof and an upper portion of the engine body 12. The opening edge of the shield cover 126 is in contact with the engine body 12. Further, the high tension cords 122 extending from the ignition coils 121L and 121R are partially covered with the shield cover 126.

Thus, the electromagnetic fuel injection valves 50L and 50R, the ignition coils 121L and 121R, and the electronic control unit 123 are covered with the common shield cover 126. Accordingly, as compared with the case where electrical parts are individually shielded, the number of parts can be reduced and the engine can be made compact as a whole. Further, since the high tension cords 122 are partially covered with the shield cover 126, individual shields for the high tension cords 122 can be removed at a portion covered with the shield cover 126, thereby improving a secondary voltage drop of each high tension cord 122.

The electronic control unit 123 is mounted on the outer surface of the front wall of the intake chamber 52, and the intake air pressure sensor 124 and the intake air temperature sensor 125 for respectively detecting an intake air pressure and an intake air temperature in the intake chamber 52 are mounted so as to project from the electronic control unit 123 through the front wall of the intake chamber 52 into the intake chamber 52. With this structure, the electronic control unit 123 can be shielded and the sensors 124 and 125 can be directly connected to the electronic control unit 123, thereby eliminating troublesome connection of conductors.

The operation of this preferred embodiment will now be described. Each second transmitting rod 91 as a pull rod is pulled toward the crankcase 21 in concert with the rotation of the camshaft 76 incorporated in the crankcase 21 and driven by the crankshaft 11. The engaging portion 94 is formed at one end portion of each second transmitting rod 91, and is disengageably engaged with the hook portion 96 of the corresponding exhaust cam follower 86. The guide member 114 fixed to the crankcase 21 of the engine body 12 includes the guide portion 113 for guiding the engaging portion 94 to the hook portion 96.

Accordingly, in engaging the engaging portion 94 of each second transmitting rod 91 to the hook portion 96 of the corresponding exhaust cam follower 86, the engaging portion 94 can be guided by the guide portion 113, thereby improving the mountability and maintainability of each second transmitting rod 91.

Each first transmitting rod 90 as a push rod adapted to be pushed toward the cylinder heads 17L and 17R in concert with the rotation of the camshaft 76 is located with each second transmitting rod 91 below the cylinder barrels 16L and 16R, thereby allowing a reduction in the size and weight of the engine body 12.

The pair of first transmitting rods 90 are commonly accommodated in the first rod case 98, and the pair of second transmitting rods 91 are individually accommodated in the second rod cases 99. The support member 102 fixed to the crankcase 21 of the engine body 12 includes the first engagement holes 103 and 104 for removably engaging one end portions of the first and second rod cases 98 and 99. On the other hand, each of the head covers 60L and 60R as a part of the engine body 12 includes the second engagement holes 105 and 106 for removably engaging the other end portions of the first and second rod cases 98 and 99. Further, the lock member 107 is detachably mounted on the support member 102, so as to inhibit axial movement of the rod cases 98 and 99 engaged with the first engagement holes 103 and 104.

With this support structure for the rod cases 98 and 99, the rod cases 98 and 99 can be easily removed from the support member 102, thereby improving the mountability and maintainability of the transmitting rods 90 and 91. Further, any means for fixing the other end portions of the rod cases 98 and 99 is not required, thereby simplifying the structure.

The transmitting rods 90 and 91 are inclined closer to the axes of the cylinder bores 18L and 18R toward the cylinder heads 17L and 17R. Accordingly, the side projection of the transmitting rods 90 and 91 from the cylinder heads 17L and 17R of the engine body 12 can be suppressed to thereby contribute to size reduction of the engine.

The hook portion 96 formed at the end portion of the connecting arm 86*a* of each exhaust cam follower 86 includes the pair of substantially C-shaped hook plates 96*a* opposed to each other with the slit 96*b* defined therebetween. On the other hand, the engaging portion 94 formed at one end portion of each second transmitting rod 91 includes the support plate 94*b* removably inserted into the slit 96*b* and the engaging pin 94*a* fixed to the support plate 94*b* for disengageably engaging the hook plates 96*a*. Further, the guide portion 113 for guiding the engaging portion 94 to the hook portion 96 is formed in the guide member 114 fixed to the crankcase 21.

The guide portion 113 includes the slide groove 115 and the inclined surface 116 connected to the slide groove 115. The slide groove 115 allows sliding of the support plate 94*b* of the engaging portion 94 from the closed side of the hook plates 96*a* of the hook portion 96 to the open side thereof. The slide groove 115 is opposed to the end portion of the connecting arm 86*a* of each exhaust cam follower 86. The inclined surface 116 guides the support plate 94*b* to such a position that the engaging pin 94*a* of the engaging portion 94 is opposed to the open side of the hook plates 96*a* of the hook portion 96. The guide member 114 having the slide groove 115 and the inclined surface 116 is formed by bending a single metal plate.

Accordingly, the guide member 114 can be easily formed with a reduced number of parts, thus contributing to an improvement in productivity.

Having thus described a preferred embodiment of the present invention, it should be noted that the present invention is not limited to the above preferred embodiment, but various modifications may be made without departing from the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve train for an OHV engine having a crankshaft, a crankcase for rotatably supporting said crankshaft, a camshaft incorporated in said crankcase so as to be rotated by transmission of rotational power from said crankshaft, cylinder barrels having cylinder bores, cylinder heads connected through said cylinder barrels to said crankcase, engine valves operably provided in said cylinder heads, and transmitting rods for transmitting a valve operating force due to the rotation of said camshaft to said engine valves comprising:

said transmitting rods as pull rods are adapted to be pulled toward said crankcase in concert with the rotation of said camshaft and are arranged on one side of said cylinder barrels;

one end portion of each transmitting rod is formed with an engaging portion disengageably engaged with a hook portion of a mating member;

a guide member is fixed to an engine body including said crankcase, said cylinder barrels, and said cylinder heads; and said engine body or said guide member is provided with a guide portion for guiding said engaging portion to said hook portion.

2. The valve train for an OHV engine according to claim 1, wherein said transmitting rods are inclined closer to the axes of said cylinder bores toward said cylinder heads.

3. The valve train for an OHV engine according to claim 1, wherein said hook portion is formed at an end portion of a connecting arm of said mating member, said hook portion being composed of a pair of substantially C-shaped hook plates opposed to each other with a slit defined therebetween;

said engaging portion is composed of a support plate and an engaging pin fixed to said support plate, said engaging pin being disengageably engaged with said hook plates, said support plate being removably inserted into said slit;

said guide member has a slide groove and an inclined surface connected to said slide groove to form said guide portion, said slide groove allowing sliding of said support plate from the closed side of said hook plates to the open side thereof and being opposed to the end portion of said connecting arm, said inclined surface guiding said support plate to such a position that said engaging pin is opposed to the open side of said hook plates;

said guide member is formed by bending a single metal plate; and said guide member is fixed to said engine body in the vicinity of said hook portion.

4. The valve train for an OHV engine according to claim 1, wherein said engaging portion includes a support plate and said guide portion includes a slide groove having an diverging portion for facilitating the insertion of the support plate into the slide groove.

5. The valve train for an OHV engine according to claim 4, wherein said engaging portion includes an engaging pin for being received by the hook portion of a mating member.

6. The valve train for an OHV engine according to claim 1, and further including an abutting portion for engaging said mating member is a fully extended position.

7. The valve train for an OHV engine according to claim 1, wherein said hook portion includes a pair of substantially C-shaped hook plates opposed to each other with a slit defined therebetween for receiving the engaging portion.

8. A valve train for an OHV engine having a crankshaft, a crankcase for rotatably supporting said crankshaft, a camshaft incorporated in said crankcase so as to be rotated by transmission of rotational power from said crankshaft, cylinder barrels having cylinder bores, cylinder heads connected through said cylinder barrels to said crankcase, engine valves operably provided in said cylinder heads, and transmitting rods for transmitting a valve operating force due to the rotation of said camshaft to said engine valves comprising:

said transmitting rods being adapted as pull rods for being pulled toward said crankcase in concert with the rotation of said camshaft, said transmitting rods being arranged on one side of said cylinder barrels;

an engaging portion being formed on one end portion of each transmitting rod for being disengageably engaged with a hook portion of a mating member;

a guide member including a guide portion for guiding said engaging portion to said hook portion.

9. The valve train for an OHV engine according to claim 8, wherein said transmitting rods are inclined closer to the axes of said cylinder bores toward said cylinder heads.

10. The valve train for an OHV engine according to claim 8, wherein said hook portion is formed at an end portion of a connecting arm of said mating member, said hook portion being composed of a pair of substantially C-shaped hook plates opposed to each other with a slit defined therebetween;

said engaging portion is composed of a support plate and an engaging pin fixed to said support plate, said engaging pin being disengageably engaged with said hook plates, said support plate being removably inserted into said slit;

said guide member has a slide groove and an inclined surface connected to said slide groove to form said guide portion, said slide groove allowing sliding of said support plate from the closed side of said hook plates to the open side thereof and being opposed to the end portion of said connecting arm, said inclined surface guiding said support plate to such a position that said engaging pin is opposed to the open side of said hook plates;

said guide member is formed by bending a single metal plate; and said guide member is fixed to said engine body in the vicinity of said hook portion.

11. The valve train for an OHV engine according to claim 8, wherein said engaging portion includes a support plate and said guide portion includes a slide groove having an diverging portion for facilitating the insertion of the support plate into the slide groove.

12. The valve train for an OHV engine according to claim 11, wherein said engaging portion includes an engaging pin for being received by the hook portion of a mating member.

13. The valve train for an OHV engine according to claim 8, and further including an abutting portion for engaging said mating member is a fully extended position.

14. The valve train for an OHV engine according to claim 8, wherein said hook portion includes a pair of substantially C-shaped hook plates opposed to each other with a slit defined therebetween for receiving the engaging portion.

15. A valve train for an OHV engine having a crankshaft, a crankcase for rotatably supporting said crankshaft, a camshaft incorporated in said crankcase so as to be rotated by transmission of rotational power from said crankshaft, cylinder barrels having cylinder bores, cylinder heads connected through said cylinder barrels to said crankcase, engine valves operably provided in said cylinder heads, and transmitting rods for transmitting a valve operating force due to the rotation of said camshaft to said engine valves comprising:

a support member fixed to an engine body including said crankcase, said cylinder barrels, and said cylinder heads;

said engine body or said support member is formed with first engagement holes for removably engaging one end portions of cylindrical rod cases accommodating said transmitting rods arranged on one side of said cylinder barrels and second engagement holes for removably engaging the other end portions of said rod cases; and a lock member for inhibiting axial movement of said rod cases engaged with said first engagement holes is detachably mounted on said engine body or said support member.

16. The valve train for an OHV engine according to claim 15, wherein said transmitting rods are inclined closer to the axes of said cylinder bores toward said cylinder heads.

17. The valve train for an OHV engine according to claim 15, wherein said cylindrical rod cases includes a first rod case and a pair of second rod cases, said first rod case including a pair of first transmitting rods being operatively positioned therein.

18. The valve train for an OHV engine according to claim 17, wherein said pair of second rod cases includes individual second transmitting rods being individually accommodated in each of the second rod cases.

19. The valve train for an OHV engine according to claim 15, and further including a head cover, said head cover including said second engagement holes being formed therein for removably engaging the other end portions of the rod cases.

20. The valve train for an OHV engine according to claim 19, wherein disconnecting the head cover permits said rod cases to be removed relative to said transmitting rods.

* * * * *